US010641017B2

(12) United States Patent
Ishiguro et al.

(10) Patent No.: US 10,641,017 B2
(45) Date of Patent: May 5, 2020

(54) VEHICLE DOOR LATCH DEVICE

(71) Applicants: MITSUI KINZOKU ACT CORPORATION, Yokohama-shi, Kanagawa (JP); GECOM CORPORATION, Greensburg, IN (US)

(72) Inventors: Katsuyuki Ishiguro, Novi, MI (US); Shigekazu Sugo, Yokohama (JP)

(73) Assignee: GECOM CORPORATION, Greensburg, IN (US)

( * ) Notice: Subject to any disclaimer, the term of this patent is extended or adjusted under 35 U.S.C. 154(b) by 73 days.

(21) Appl. No.: 15/825,385

(22) Filed: Nov. 29, 2017

(65) Prior Publication Data

US 2018/0216370 A1 Aug. 2, 2018

(30) Foreign Application Priority Data

Jan. 30, 2017 (JP) ..... 2017-014085

(51) Int. Cl.

| | |
|---|---|
| ***E05B 77/34*** | (2014.01) |
| ***E05B 77/04*** | (2014.01) |
| ***E05B 85/20*** | (2014.01) |
| ***E05B 85/02*** | (2014.01) |
| ***E05B 77/06*** | (2014.01) |
| *E05B 85/04* | (2014.01) |

(52) U.S. Cl.

CPC ..... *E05B 77/34* (2013.01); *E05B 77/04* (2013.01); *E05B 77/06* (2013.01); *E05B 85/02* (2013.01); *E05B 85/20* (2013.01); *E05B 85/04* (2013.01)

(58) Field of Classification Search

CPC ..... E05B 77/00; E05B 77/04; E05B 77/06; E05B 77/34; E05B 85/00; E05B 85/02; E05B 85/20; E05B 85/04

USPC ..... 70/237; 292/341.14, DIG. 27, DIG. 37

See application file for complete search history.

(56) References Cited

U.S. PATENT DOCUMENTS

| | | | | |
|---|---|---|---|---|
| 2,603,963 | A * | 7/1952 | Allen | E05B 83/16 292/DIG. 27 |
| 5,564,761 | A * | 10/1996 | Mizuki | E05B 81/20 292/201 |
| 6,364,379 | B1 * | 4/2002 | Roberts | E05B 83/16 292/216 |
| 7,637,542 | B2 * | 12/2009 | Suzumura | E05B 77/34 292/201 |

(Continued)

FOREIGN PATENT DOCUMENTS

| | | |
|---|---|---|
| JP | 2004-204490 A | 7/2004 |
| JP | 2016-505098 A | 2/2016 |

*Primary Examiner* — Suzanne L Barrett

(74) *Attorney, Agent, or Firm* — Davis & Bujold PLLC; Michael J. Bujold

(57) ABSTRACT

A vehicle door latch device comprises an engagement mechanism housing having a striker entering groove into which a striker can enter, a cover member occluding an opening of the engagement mechanism housing, a latch pivotally mounted in the engagement mechanism housing and capable of engaging with the striker which has entered the striker entering groove, a ratchet pivotally mounted in the engagement mechanism housing and capable of engaging with the latch, and movable elements relating to the operation of the ratchet. The housing has a guide path through which the invasion fluid can be guided to an outside direction of a region that the movable elements are disposed.

3 Claims, 15 Drawing Sheets

(56) References Cited

U.S. PATENT DOCUMENTS

| | | | | |
|---|---|---|---|---|
| 9,534,425 | B2 * | 1/2017 | Hunt | E05B 77/06 |
| 9,631,402 | B2 * | 4/2017 | Bejune | E05B 77/06 |
| 9,879,450 | B2 * | 1/2018 | Wahmann | E05B 77/54 |
| 9,920,555 | B2 * | 3/2018 | Brickner | E05B 77/12 |
| 2004/0262927 | A1 * | 12/2004 | Fukunaga | E05B 77/34 292/216 |
| 2006/0261602 | A1 * | 11/2006 | Jankowski | E05B 77/12 292/216 |
| 2012/0110920 | A1 * | 5/2012 | Takagi | E05B 77/06 49/503 |
| 2014/0035295 | A1 * | 2/2014 | Bendel | E05B 77/06 292/100 |
| 2014/0132008 | A1 * | 5/2014 | Bendel | E05B 85/26 292/92 |
| 2014/0175813 | A1 * | 6/2014 | Margheritti | E05B 77/34 292/201 |
| 2014/0203575 | A1 | 7/2014 | Brickner et al. | |
| 2016/0348407 | A1 * | 12/2016 | Madrid | E05B 77/34 |

* cited by examiner

VEHICLE DOOR LATCH DEVICE

TECHNICAL FIELD

The present invention relates to a vehicle door latch device that dust or water invaded into a housing can be effectively discharged to the outside.

BACKGROUND OF THE INVENTION

Patent Literature 1 discloses a vehicle door latch device wherein a latch capable of engaging with a striker and a ratchet capable of engaging with the latch are disposed in an engagement mechanism housing having a striker entering groove, and a drain passage is provided at a lower edge of the engagement mechanism housing, thereby a rain water invading into the engagement mechanism housing from the striker entering groove is discharged to the outside through the drain passage without staying, and it becomes possible to maintain good operation of the latch and the ratchet as there is no risk of rain water freezing at low temperature.

Patent Literature 2 discloses a vehicle door latch device which comprises a latch capable of engaging with a striker, a ratchet capable of engaging with the latch, an opening lever causing the ratchet to perform a releasing operation, and a crash releasing prevention mechanism disposed lower than the ratchet and preventing an opening of a door by preventing a rotation of the ratchet when the opening lever rotates at an excessive speed due to a crash accident or the like. The crash releasing prevention mechanism is constituted by movable elements that influence the operation of the ratchet.

PRIOR ART

Patent Literatures

Patent Literature 1: JP2004-204490A
Patent Literature 2: JP2016-505098A

SUMMARY OF THE INVENTION

Problem to be Solved by the Invention

The vehicle door latch devices disclosed in the Patent Literatures 1 and 2 are not taken any countermeasures to regulate the discharge direction of dust or water invaded from the striker entering groove, thus, there are possibilities that dust or water invaded into the engagement mechanism housing stays as it is and adheres to the movable elements of the crash releasing prevention mechanism, or invades to an accommodation portion provided on a back side of the engagement mechanism housing and adheres to the movable elements constituting the locking/unlocking mechanism, so that the crash releasing prevention mechanism and the locking/unlocking mechanism having the movable elements related to the operation of the ratchet may lead to malfunction.

In view of the above problems, it is an object of the present invention to provide a vehicle door latch device which ensures the operation of the crash releasing prevention mechanism and the locking/unlocking mechanism.

Means for Solving the Problems

In order to solve the above problem, a first invention is a vehicle door latch device, the device comprises a housing having a striker entering groove into which a striker can enter, a cover member occluding an opening of the housing, a latch pivotally mounted in the housing and capable of engaging with the striker which has entered the striker entering groove, a ratchet pivotally mounted in the housing and capable of engaging with the latch, and movable elements relating to the operation of the ratchet, wherein the housing has a guide path through which an invasion fluid can be guided to an outside direction of a region that the movable elements are disposed.

A second invention is a vehicle door latch device in the first invention wherein the guide path is located lower than the striker entering groove and higher than the region, and is inclined so as to guide the invasion fluid in the outside direction.

A third invention is a vehicle door latch device in the first or second invention wherein the outside direction is a relative direction that is inclined in the entering direction of the striker.

A fourth invention is a vehicle door latch device in any one of the first to third inventions wherein the cover member has a drainage portion for discharging the invasion fluid to the outside.

A fifth invention is a vehicle door latch device in the fourth invention wherein other guide path is provided on a lower side of the guide path, and downstream portions of both guide paths join together before reaching the drainage portion.

A sixth invention is a vehicle door latch device in the fifth invention wherein the movable elements are a crash releasing prevention mechanism and are disposed lower than the ratchet in the housing, the other guide path is constituted by an eaves portion that covers the upper side of the crash releasing prevention mechanism.

A seventh invention is a vehicle door latch device in the fifth invention wherein the movable elements are the locking/unlocking mechanism disposed on the back side of the housing, and occlude a hole provided in the housing.

Advantages of the Invention

According to the present invention, by providing the guide path in the housing, invasion of the invasion fluid such as dust or water into the region that the movable elements related to the operation of the ratchet are disposed is reduced, and malfunction of the movable elements can be suppressed.

EMBODIMENTS OF THE INVENTION

Hereinafter, one embodiment of the present invention will be described with reference to the drawings.

Figure 1:
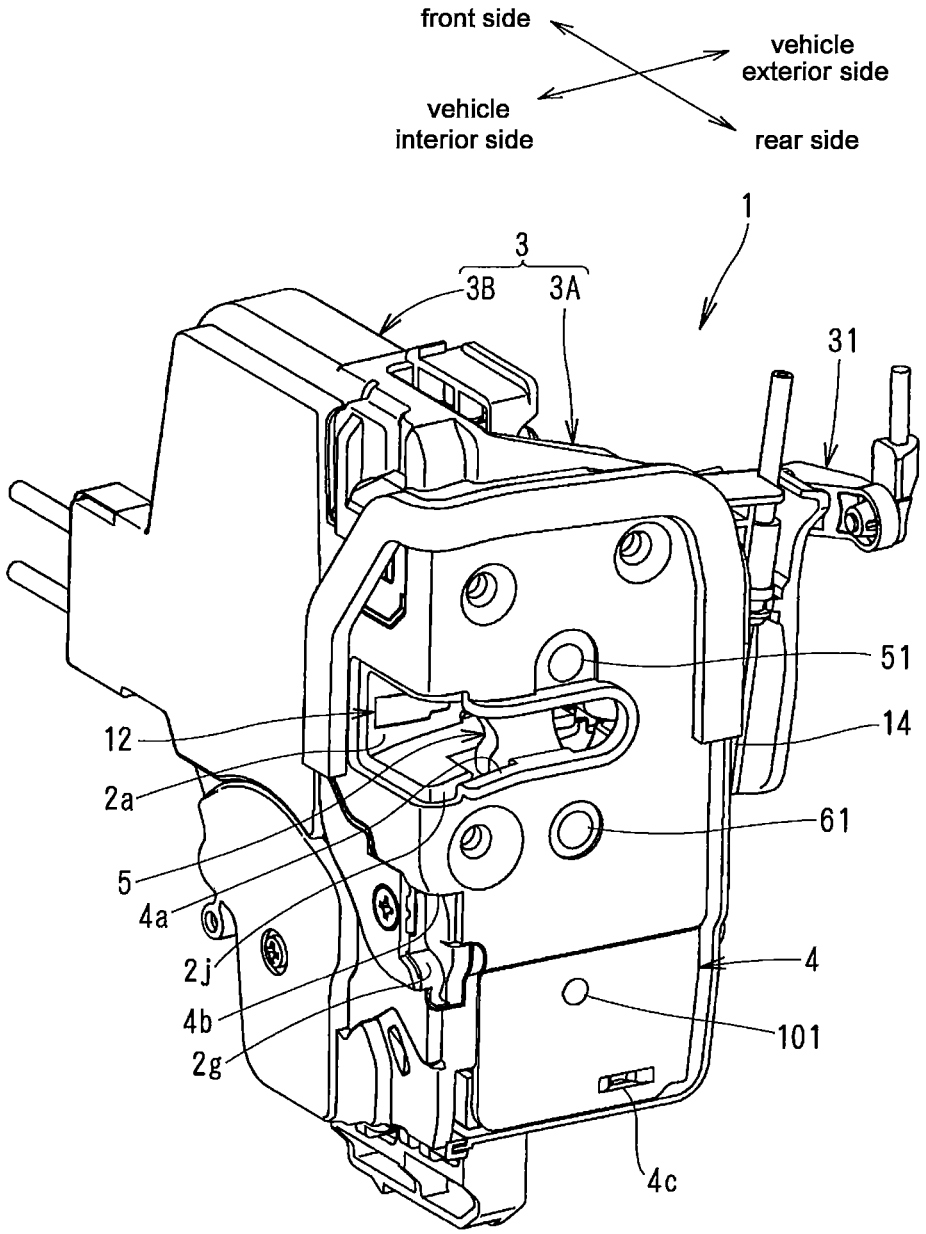
FIG. 1 is a perspective view of a vehicle door latch device according to one embodiment of the present invention viewed obliquely from the front face.
Figure 2:
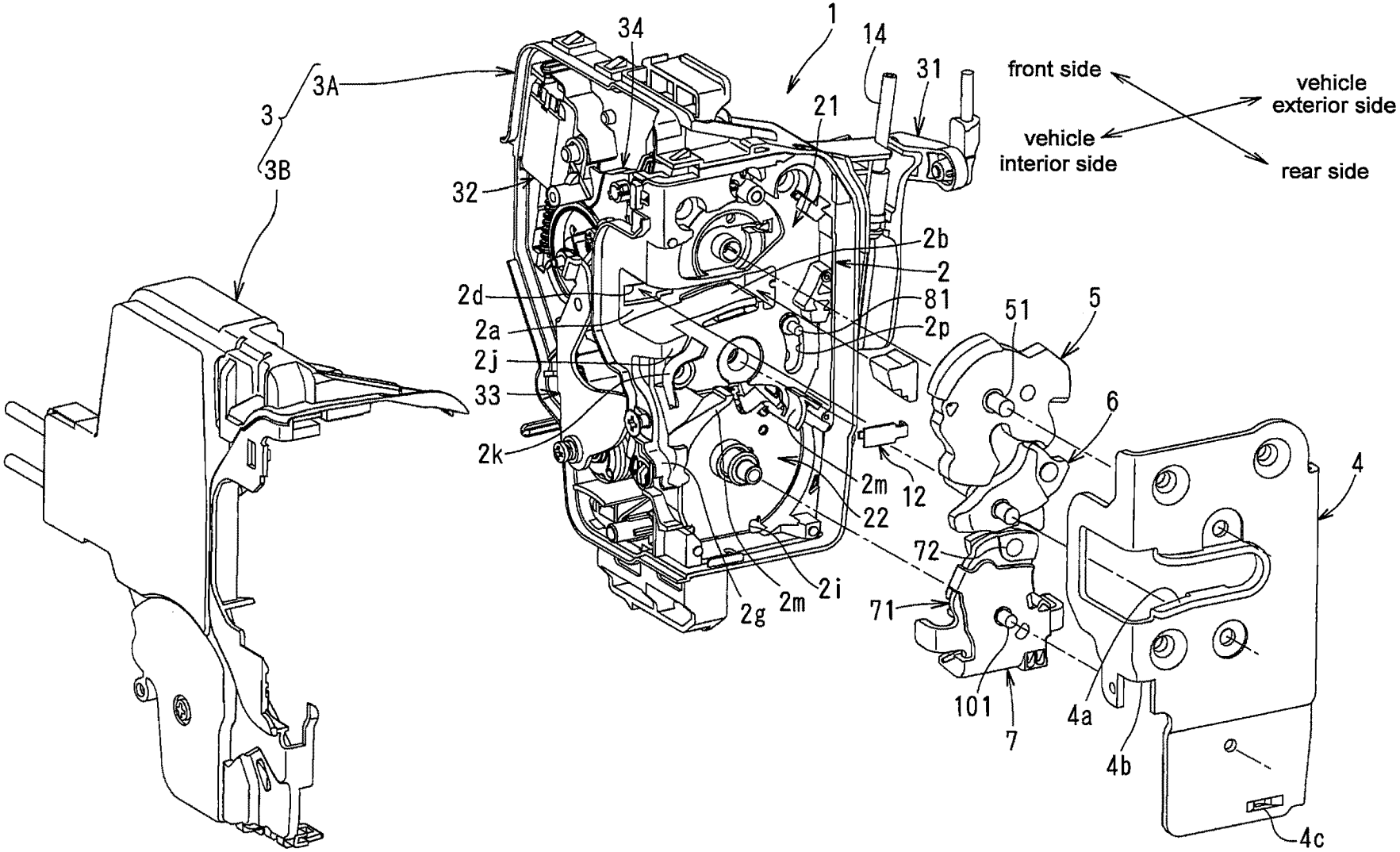
FIG. 2 is an exploded perspective view of the vehicle door latch device.
Figure 3:
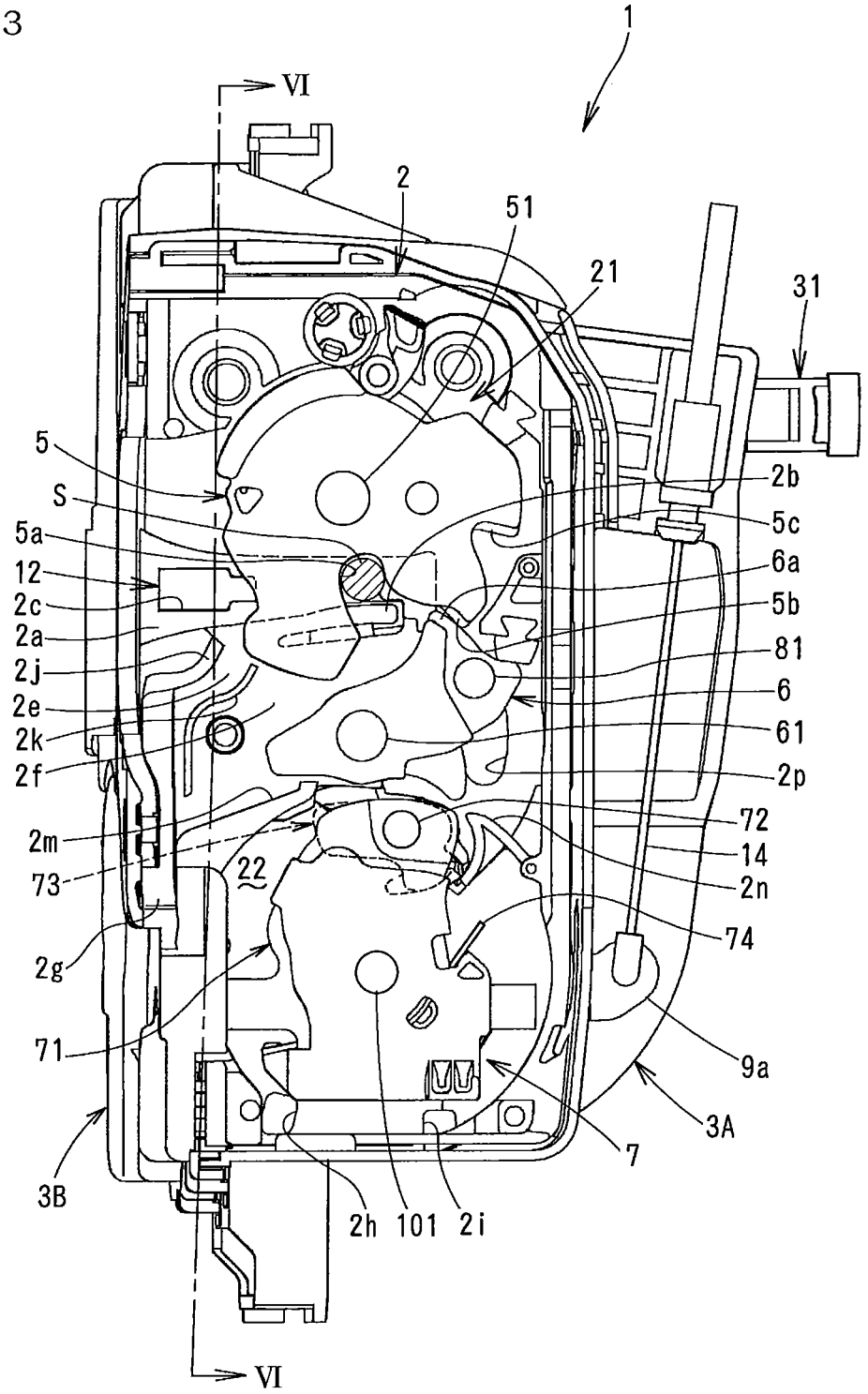
FIG. 3 is a front elevational view of an engagement unit.
Figure 4:
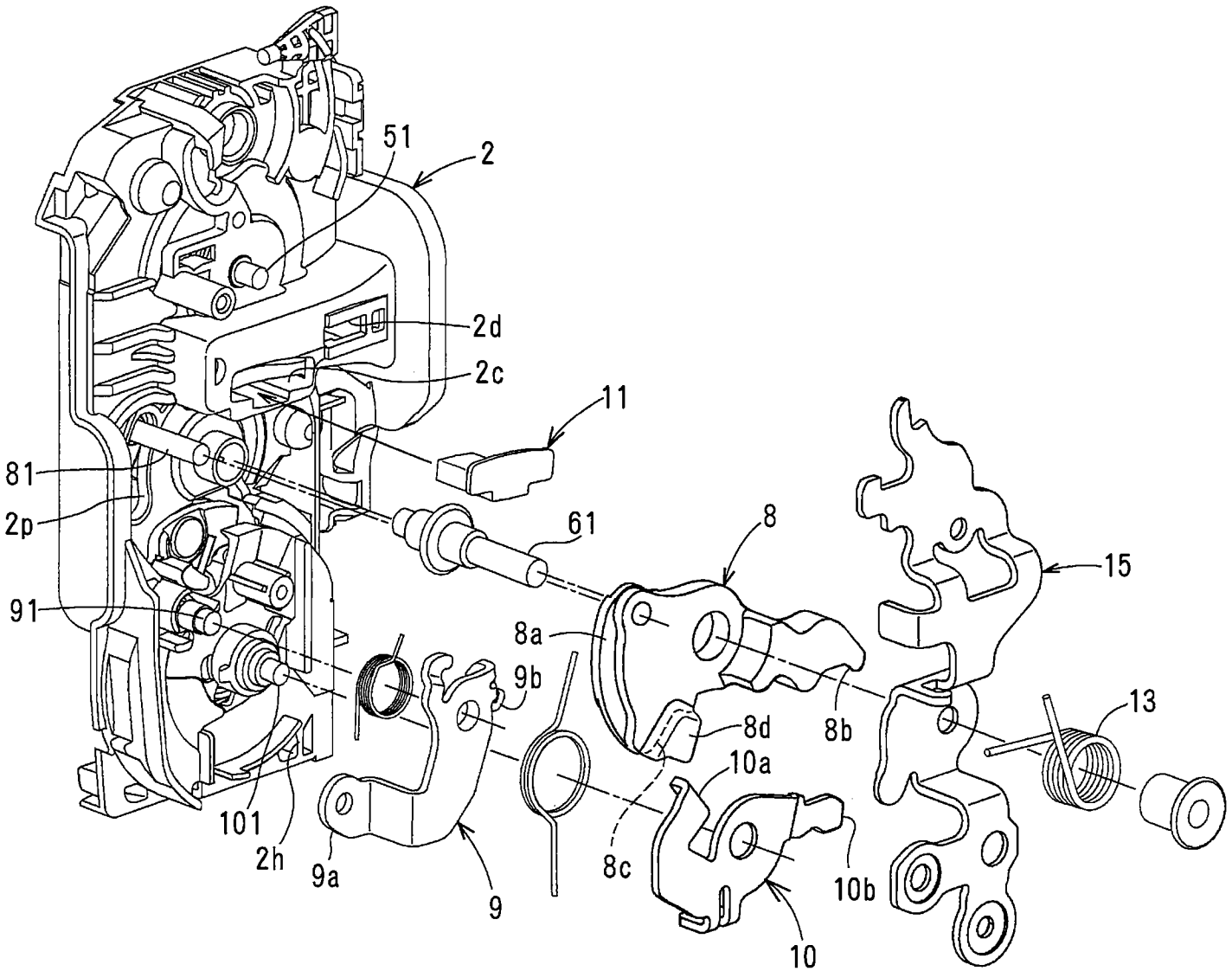
FIG. 4 is an exploded perspective view of the engagement unit viewed obliquely from the back side.
Figure 5:
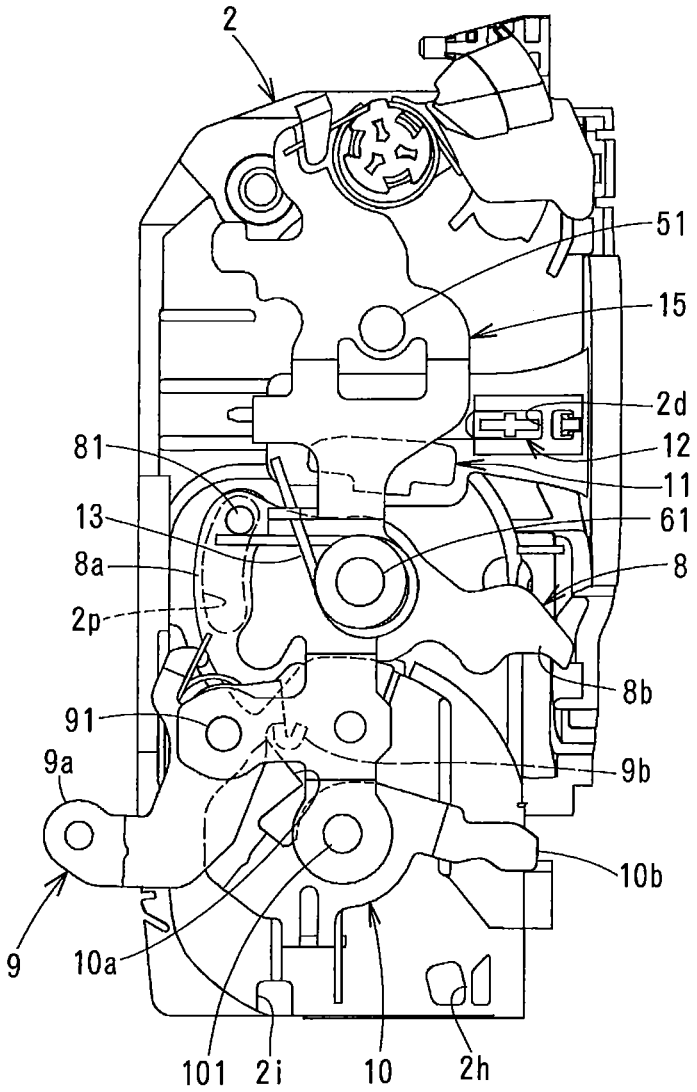
FIG. 5 is a back view of the engagement unit.

FIG. 1 is a perspective view of the vehicle door latch device 1, FIG. 2 is an exploded perspective view of the vehicle door latch device 1, FIG. 3 is a front elevational view of the engagement unit, FIG. 4 is an exploded perspective view of the engagement unit viewed from the back side, and FIG. 5 is a back view of the engagement unit. In addition, the directions (left side, right side, front face side, back face side) used in the following description correspond to the directions (vehicle interior side, vehicle exterior side, rear side, front side) in the condition that the vehicle door latch device 1 is attached to a door.

The vehicle door latch device 1 is disposed at a rear end in a front door (hereinafter referred to as a door) which is pivotally mounted so as to be able to open and close around a hinge shaft facing in the vertical direction on a vehicle body side surface. The vehicle door latch device 1 comprises an engagement unit (not signed) having an engagement mechanism housing 2 that houses an engagement mechanism described later that holds the door in a closed state by engaging with a striker S on the vehicle body side, and an operation unit (not signed) having an operation mechanism housing 3 that houses a locking/unlocking unit and other elements described later.

On a vehicle exterior side surface of the door, a key cylinder (not shown) for manual locking/unlocking operation and an outside handle (not shown) operated when the door is opened from the vehicle exterior side and forming a door opening operation means on the vehicle exterior side are disposed. On a vehicle interior side surface of the door, a locking knob (not shown) for manual locking/unlocking operation and an inside handle (not shown) operated when the door is opened from the vehicle interior side and forming a door opening operation means on the vehicle interior side are disposed.

The engagement unit has the engagement mechanism housing 2 made of synthetic resin described above, in which an opening facing the front face side is occluded by a metal cover member 4. In a first region 21 formed in an upper half of a space of the engagement mechanism housing 2 (a space formed between the engagement mechanism housing 2 and the cover member 4), the engagement mechanism (not signed) constituted of a latch 5 capable of engaging with the striker S and a ratchet 6 capable of engaging with the latch 5 is disposed. In a second region 22 formed in a lower half of the space of the engagement mechanism housing 2, a crash releasing prevention mechanism 7 performing an operation affecting an operation of the ratchet 6 is disposed.

When a door panel was deformed due to a crash accident or the like, the crash releasing prevention mechanism 7 performs an operation for prohibiting a releasing operation of the ratchet 6, that is, an operation related to an operation of the ratchet 6. This operation will be described later.

As shown in FIGS. 4 and 5, on the back side of the engagement mechanism housing 2, an opening lever 8 rotating integrally with the ratchet 6, a first outside lever 9 connected to the outside handle, and a second outside lever 10 interlocking with the outside lever 9 are disposed. The engagement mechanism housing 2 is fixed to the door by a plurality of bolts (not shown) so that the cover member 4 (refer to FIGS. 1 and 2) faces the rear end inner surface of the door.

As shown in FIG. 3, the latch 5 of the engagement mechanism is positioned higher than a striker entering groove 2*a* of the engagement mechanism housing 2 and is pivotally mounted by a latch shaft 51 in the first region 21 formed in the upper half of the engagement mechanism housing 2. The latch 5 has an engagement groove 5*a* with which the striker S is capable of engaging, a full latch engaging portion 5*b* and a half latch engaging portion 5*c* with which a claw portion 6*a* of the ratchet 6 is capable of engaging from below. Along with the closing operation of the door, by rotating a predetermined angle counterclockwise from an opening position (a position rotated by approximately 90 degrees clockwise from the position shown in FIG. 3) against an urging force of the spring (not shown) acting on the latch 5, the latch 5 passes through a half latch position that the striker S slightly engages with the engagement groove 5*a*, and then rotates to a full latch position shown in FIG. 3 that the striker S completely engages with the engagement groove 5*a*. In addition, along with the opening operation of the door, the latch 5 rotates in the opposite direction. In FIG. 3, in order to clearly show the internal structure of the engagement unit, the cover member 4 is omitted.

The ratchet 6 is located lower than the striker entering groove 2*a* of the engagement mechanism housing 2, is pivotally mounted on the first region 21 of the engagement mechanism housing 2 by a ratchet shaft 61, and is urged in the engaging direction (counterclockwise direction in FIG. 3) by a spring 13 acting on the opening lever 8. In addition, the ratchet 6 holds the latch 5 in the half latch position (semi-closed state) by engaging the claw portion 6*a* with the half latch engaging portion 5*c*, and holds the latch 5 in the full latch position (fully closed state) by engaging the claw portion 6*a* with the full latch engaging portion 5*b*. Further, against the urging force of the spring 13, the claw portion 6*a* performs the releasing operation from the engagement position (position shown in FIG. 3) engaged with the full latch engaging portion 5*b* (or half latch engaging portion 5*c*) to the releasing direction (clockwise direction in FIG. 3), whereby the claw portion 6*a* is disengaged from the full latch engaging portion 5*b* (or half latch engaging portion 5*c*), and it is possible to open the door.

The opening lever 8 is pivotally mounted by the ratchet shaft 61 on a back face of the engagement mechanism housing 2, and rotates integrally with the ratchet 6 by being connected to the ratchet 6 using a connecting pin 81. The connecting pin 81 penetrates an arcuate hole 2*p* provided in the engagement mechanism housing 2, and one end thereof is fixed to the ratchet 6 and the other end thereof is fixed to the opening lever 8, thereby the ratchet 6 and the opening lever 8 are connected each other.

The opening lever 8 is provided with a covering portion 8*a* for covering the arcuate hole 2*p* of the engagement mechanism housing 2 from the back face side. The covering portion 8*a* prevents that the invasion fluid such as dust or water that have invaded into the first region 21 of the engagement mechanism housing 2 pass through the arcuate hole 2*p* and invade into a back side of the engagement mechanism housing 2, that is, a third region 30 (refer to FIG. 6) in the operation mechanism housing 3 provided on the back side of the engagement mechanism housing 2.

A first outside lever 9 is pivotally mounted by a shaft 91 at the lower portion of the back face of the engagement mechanism housing 2 and one end portion 9*a* is connected to the outside handle through a Bowden cable 14 in the vertical direction. Thereby, due to the door opening operation of the outside handle, the first outside lever 9 is rotated by a predetermined angle in the releasing direction (clockwise direction in FIG. 5) around the shaft 91, and transmits the rotation to the second outside lever 10.

A second outside lever 10 is pivotally mounted by a shaft 101 at the lower portion of the back face of the engagement mechanism housing 2. When the first outside lever 9 rotates in the releasing direction, a bent portion 9*b* of the first outside lever 9 abuts against one end portion 10*a*, so that the second outside lever 10 rotates around the shaft 101 in the releasing direction (counterclockwise direction in FIG. 5) by a predetermined angle. With this rotation, as shown in FIG. 6, a lifting lever 35 connected swinging possible to the other end portion 10*b* is performed the releasing operation (upward movement).

As shown in FIG. 5, the opening lever 8 and the first and second outside levers 9, 10 are pivotally mounted by respective shafts between the back face of the engagement mechanism housing 2 and a metal back member 15 fixed to said back face.

As shown in FIGS. 1 and 2, the operation mechanism housing 3 of the operation unit has a first housing 3A fixed to the back side of the engagement mechanism housing 2 so as to cover the back side of the engagement mechanism housing 2, and a second housing 3B occluding a surface facing the left side (vehicle interior side) of the first housing 3A. The third region 30 described above is formed in a space between the first housing 3A and the second housing 3B and a space between the first housing 3A and the back face of the engagement mechanism housing 2.

Figure 6:
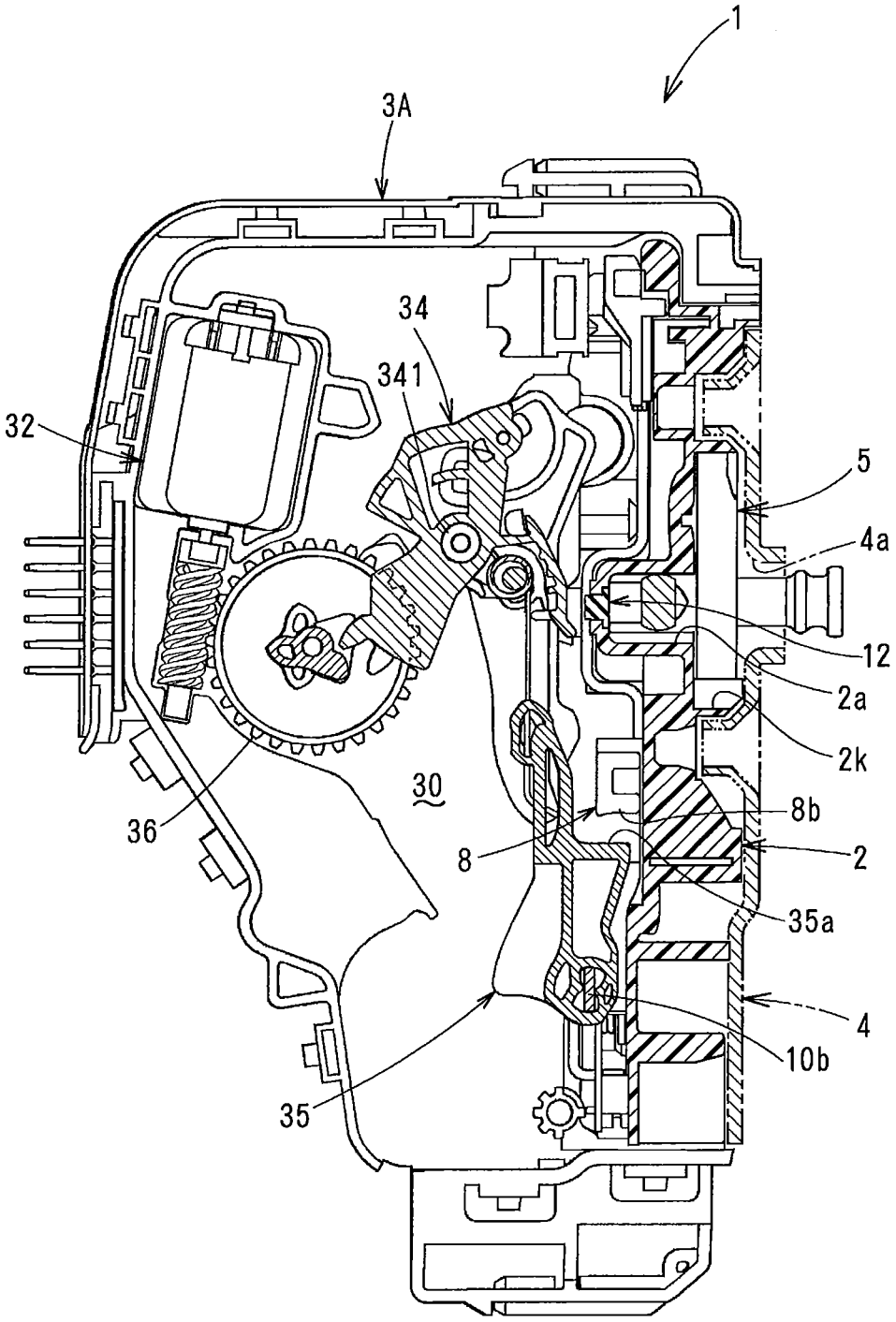
FIG. 6 is a cross-sectional view taken along the line VI-VI in FIG. 3.

FIG. 6 is a cross-sectional view taken along the line VI-VI in FIG. 3.

A key lever 31 connected to the key cylinder is pivotally mounted on an upper outer side of the first housing 3A (refer to FIGS. 1 and 2). In the third region 30 of the operating mechanism housing 3, as shown in FIG. 6, an electric motor 32 capable of driving by a remote locking/unlocking operation of a portable device that a driver carries, an inside lever 33 (refer to FIG. 2) connected to the inside handle, a reduction gear 36 reducing the rotation of the electric motor 32 and transmitting to a locking lever 34 described later, and a locking/unlocking mechanism (not signed) having movable elements which affect the operation of the ratchet 6 are disposed.

As shown in FIG. 6, the locking/unlocking mechanism is constituted of a locking lever 34 and a lifting lever 35 connected to the locking lever 34 as movable elements. The locking/unlocking mechanism comprises the switchable constitution to the unlocking state in which the door opening operation of the outside handle is permitted and the locking state in which the door opening operation is prohibited by the manual locking/unlocking operation (the key cylinder operation or the locking knob operation) or the electric operation of the electric motor 32 by the remote operation of the portable device. As a result, as an operation affecting the operation of the ratchet 6, the locking/unlocking mechanism performs a switching operation to either the unlocked state in which the ratchet 6 can be performed the releasing operation and the locked state in which the ratchet 6 cannot be performed the releasing operation by the door opening operation of the outside handle.

The locking lever 34 is pivotally mounted on the third region 30 by a shaft 341. By the manual operation of the key cylinder and the locking knob and the electric operation by the power of the electric motor 32, the lock lever 34 can move to the unlocking position (the position shown in FIG. 6) corresponding to the unlocked state and the locking position corresponding to the locked state rotated clockwise from the unlocking position by a predetermined angle.

An upper portion of the lifting lever 35 is connected sliding possible to the locking lever 34 in the vertical direction and a lower portion of the lifting lever 35 is connected swinging possible to the other end portion 10*b* of the second outside lever 10. As a result, along with the movement of the locking lever 34, the lifting lever 35 moves to the unlocking position shown in FIG. 6 and to the locking position rotated counterclockwise by a predetermined angle from the unlocking position.

In the case that the locking/unlocking mechanism is in the unlocked state, when the outside handle is performed the door opening operation, the lifting lever 35 performs the releasing operation (upward movement in FIG. 6) through the first and second outside levers 9, 10 based on the operation. As a result, a releasing portion 35*a* of the lift lever 35 abuts against an end portion 8*b* of the opening lever 8 from the lower side and the ratchet 6 and the opening lever 8 perform the releasing operation, thereby the door can be opened. In addition, when the inside handle is performed the door opening operation, the inside lever 33 rotates based on the operation, so that the inside lever 33 abuts against the end portion 8*b* of the opening lever 8 from the lower side and the opening lever 8 and the ratchet 6 perform the releasing operation, thereby the door can be opened.

Figure 7:
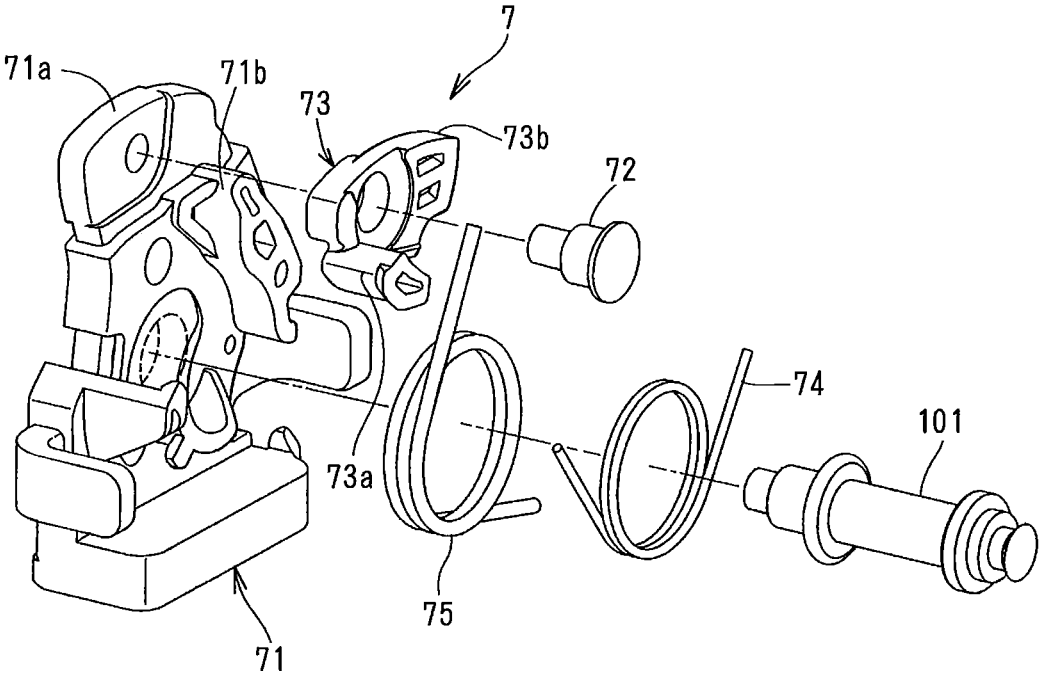
FIG. 7 is an exploded perspective view of a crash releasing prevention mechanism.
Figure 8:
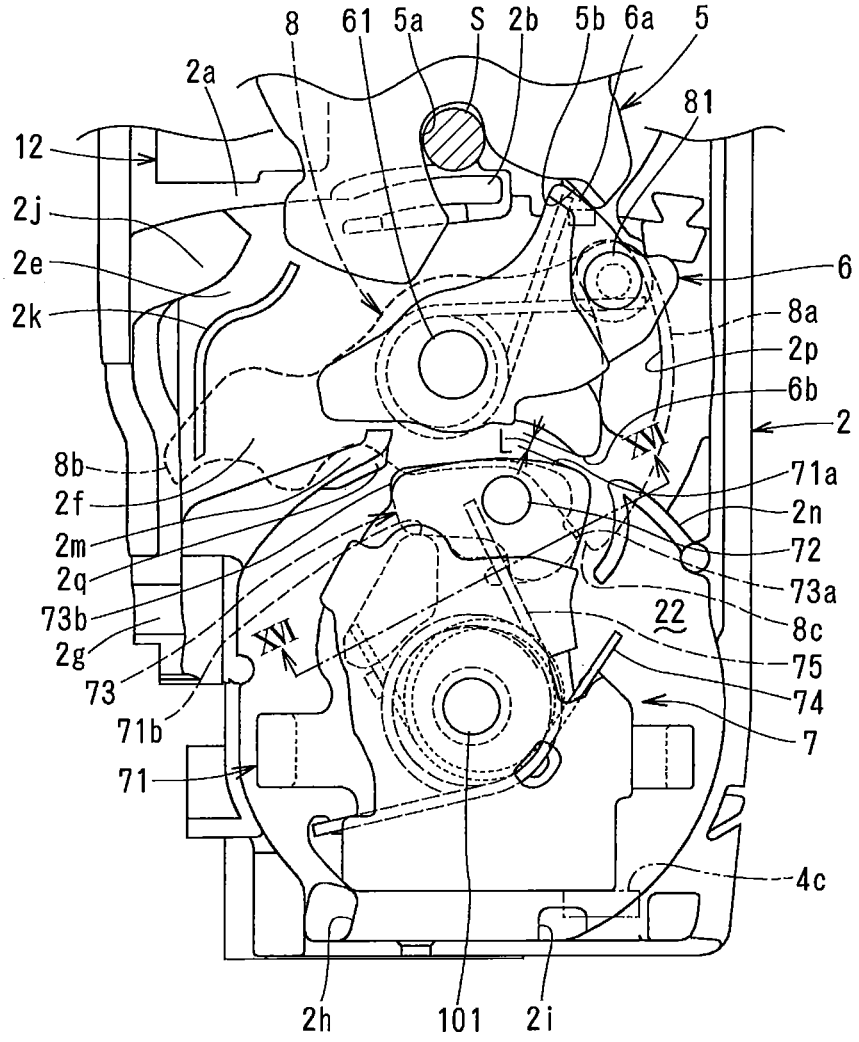
FIG. 8 is a front elevational view for explaining the crash releasing prevention mechanism when it is in an initial state.
Figure 9:
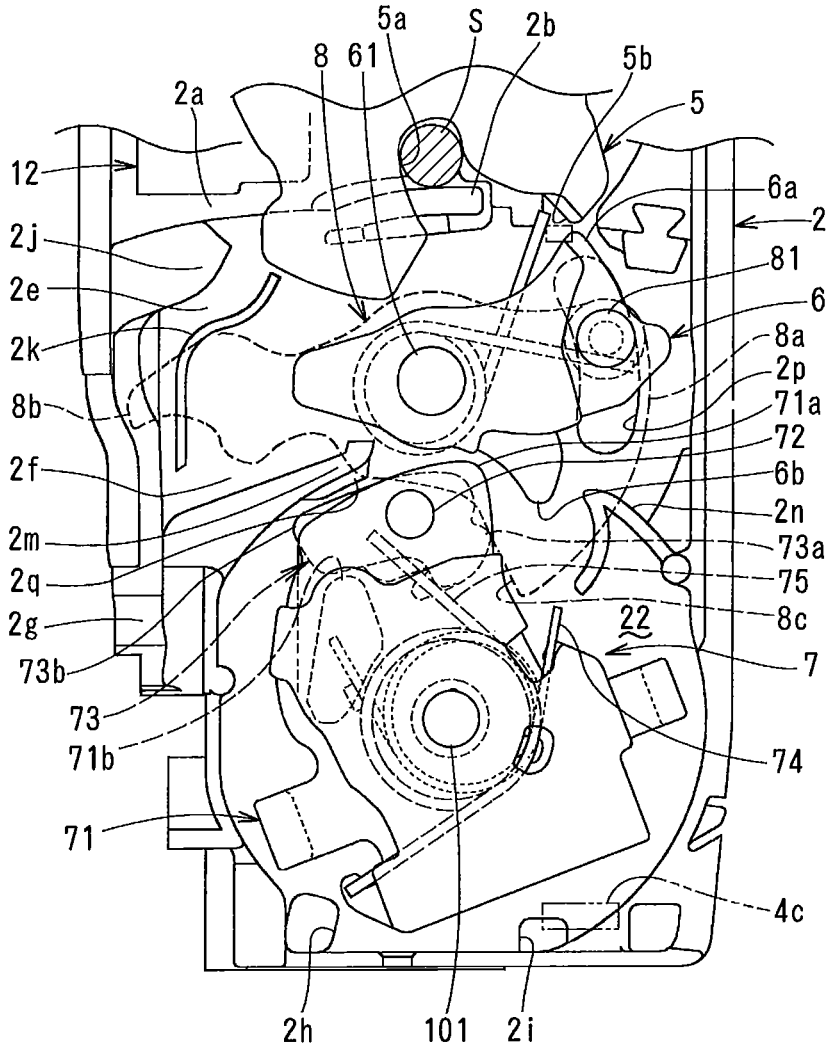
FIG. 9 is a front elevational view for explaining the crash releasing prevention mechanism when it is in a releasing operation state.
Figure 10:
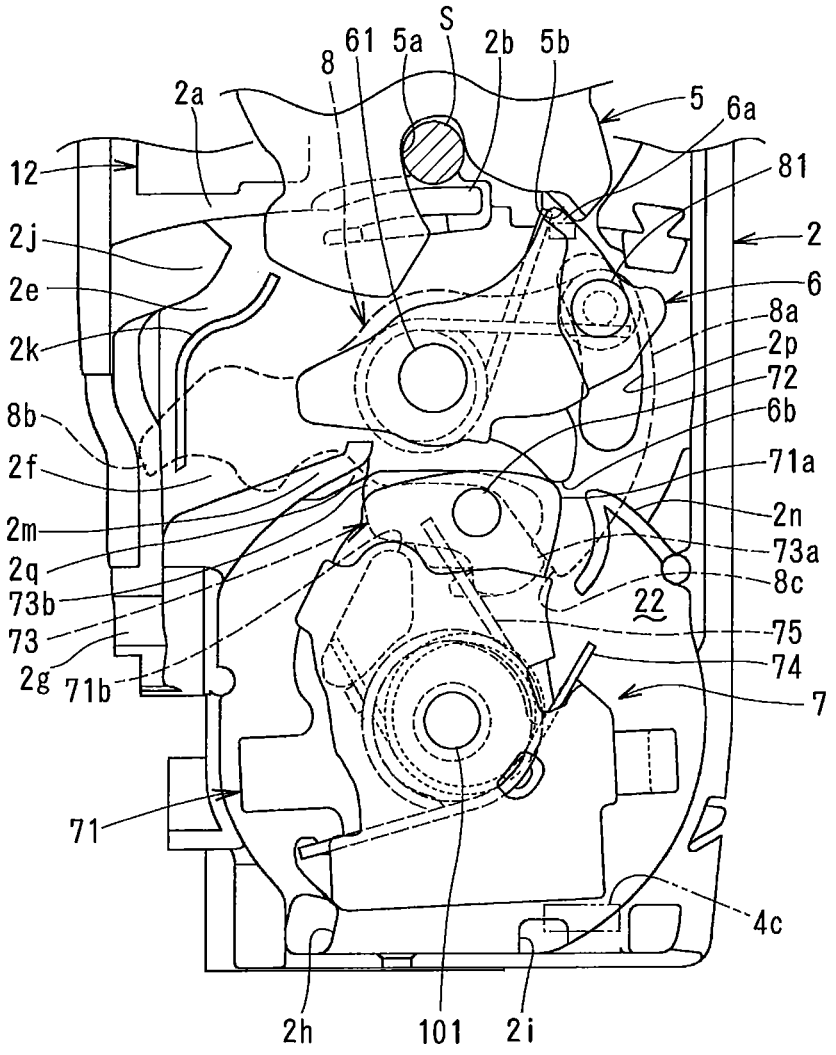
FIG. 10 is a front elevational view for explaining the crash releasing prevention mechanism when it is in a blocking operation state.

FIG. 7 is an exploded perspective view of a crash releasing prevention mechanism 7 viewed from the back side. FIGS. 8 to 10 are a front elevational view for explaining the operation of the crash releasing prevention mechanism 7.

The crash releasing prevention mechanism 7 is constituted of a first lever 71 pivotally mounted by a shaft 101 coaxial with the second outside lever 10 in the second region 22 formed in the lower half of the engagement mechanism housing 2, a second lever 73 made of a synthetic resin and pivotally mounted by a shaft 72 on an upper portion of the first lever 71, a first spring 74 acting on the first lever 71, and a second spring 75 acting on the second lever 73.

By being retained one end of the first spring 74 to the engagement mechanism housing 2 and the other end to the first lever 71 respectively, the first spring 74 applies the urging force in the clockwise direction around the shaft 101 against the first lever 71 as shown in FIGS. 8 to 10.

By being retained one end of the second spring 75 to the first lever 71 and the other end to the second lever 73 respectively, the second spring 75 applies the urging force in the counterclockwise direction around the shaft 72 against the second lever 73 as shown in FIGS. 8 to 10. In addition, the urging force of the second spring 75 acting on the second lever 73 is set to be larger than the urging force of the first spring 74 acting on the first lever 71.

The first lever 71 has a constitution that a metal plate material is coated with a synthetic resin material, in the initial state, with the urging force of the first spring 74, a right lower end of the first lever 71 is held in an initial position shown in FIG. 8 which abuts against the stopper 4*c* provided on the cover member 4 from the clockwise direction.

Further, in a subassembly in which the second lever 73 and the second spring 75 are assembled, the first lever 71 is formed such that a center of gravity is positioned at a center of rotation (a shaft center of the shaft 101). As a result, even if an inertial force (acceleration) acts from any direction at the time of a crash, the first lever 71 in the subassembly state is held in the initial position without rotating.

In a state that the first lever 71 is held at the initial position, as can be understood from FIG. 8, a gap L is provided between a blocking portion 71*a* of an arc shape (the arc that a position deviated by about 2 mm to the right side of the shaft 101 is a center) provided at an upper edge of the first lever 71 and a tip of an abutting portion 6*b* of a claw shape provided at a lower end of the ratchet 6 facing the blocking portion 71*a*.

The gap L is set so as to be smaller than a dimension corresponding to an engaging margin at which the claw portion 6*a* of the ratchet 6 engages with the full latch engaging portion 5*b* (or the half latch engaging portion 5*c*) of the latch 5.

The second lever 73 is pivotally mounted by the shaft 72 on the upper portion of the first lever 71 by a predetermined angle, in the initial state, with the urging force of the second spring 75, a left lower end of the second lever 73 is held in the initial position shown in FIG. 8 which abuts against an upper end of the stopper portion 71*b* provided on the back face of the first lever 71. A force for rotating the first outside lever 9 to the releasing direction acts directly or indirectly by a deformation of the door panel due to crash or the like, as a result, when the ratchet 6 and the opening lever 8 rotate at a high speed to the releasing direction, the second lever 73, against the urging force of the second spring 75, rotates from the initial position to a blocking position shown in FIG. 10 which is rotated by a predetermined angle clockwise around the shaft 72.

In a state that the second lever 73 is held at the initial position, as can be understood from FIG. 8, so as to be able to permit the rotation of the first lever 71 to the releasing direction (counterclockwise direction), the second lever 73 is held in a posture that a tip portion 73*b* does not abut against a stopper portion 2*q* provided on a lower surface of a third eaves portion 2*m* described later provided in the engagement mechanism housing 2 from the counterclockwise direction.

In a state that the second lever 73 is displaced to the blocking position, as can be understood from FIG. 10, so as to be able to prohibit (prevent) the rotation of the first lever 71 to the releasing direction, the second lever 73 becomes a posture in which the tip portion 73*b* projects upward from the upper edge of the first lever 71 and can abut against the stopper portion 2*q* from the counterclockwise direction.

Then, the operation of the crash releasing prevention mechanism 7 will be described.

When the door is in the closed state, as shown in FIG. 8, the latch 5 is in the fully latched position and is held in the engagement position that the claw portion 6*a* of the ratchet 6 is engaged with the full latch engaging portion 5*b* of the latch 5. The crash releasing prevention mechanism 7 is in the initial state, and the first lever 71 and the second lever 73 are held in their respective initial positions by the urging forces of the first and second springs 74 and 75.

In the initial state shown in FIG. 8, when the locking/unlocking mechanism is in the unlocked state and the outside handle is manually performed the door opening operation, along with the rotation of the first and second outside levers 9 and 10, the lift lever 35 performs the releasing operation. As a result, a releasing portion 35*a* of the lift lever 35 abuts against an end portion 8*b* of the opening lever 8 from the lower side, and the ratchet 6 and the opening lever 8 perform the releasing operation. In addition, when the inside handle is manually performed the door opening operation, along with the rotation of the inside lever 33, the ratchet 6 and the opening lever 8 perform the releasing operation.

When the ratchet 6 and the opening lever 8 perform the releasing operation, in the initial operation, an abutting portion 8*c* provided at the lower portion of the opening lever 8 abuts against the abutted portion 73*a* provided at the right lower portion of the second lever 73, thereby the first lever 71 and the second lever 73 integrally rotate counterclockwise around the shaft 101. In this case, since the urging force of the second spring 75 acting on the second lever 73 is greater than the urging force of the first spring 74 acting on the first lever 71, the second lever 73 does not displace from the initial position to the blocking position against the urging force of the second spring 75.

As a result, when the outside handle or the inside handle is manually performed the door opening operation, as shown in FIG. 9, the crash releasing prevention mechanism 7 permits the releasing operation of the ratchet 6 and enables the opening of the door.

Figure 16:
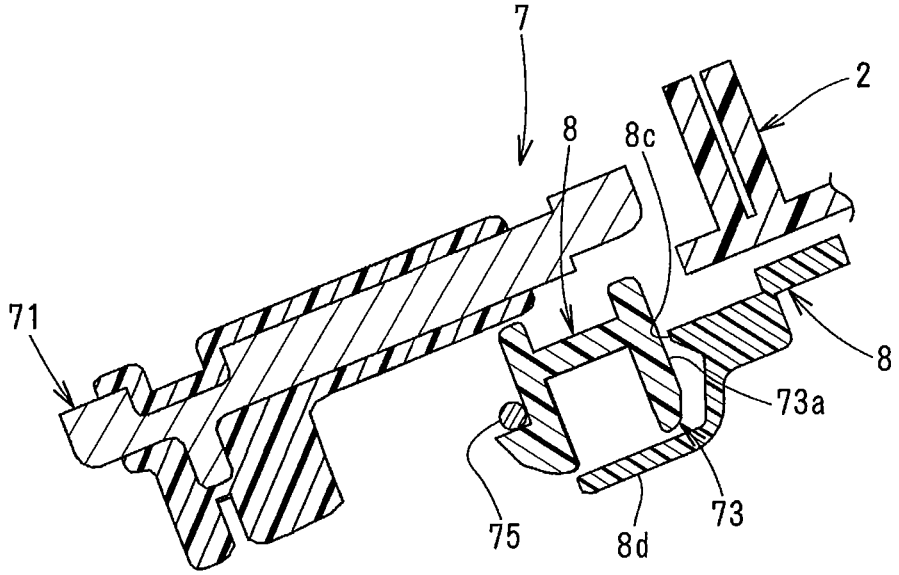
FIG. 16 is a cross-sectional view taken along the line XVI-XVI in FIG. 8.

As shown in FIG. 16, the abutting portion 8*c* of the opening lever 8 is a sharp end shape and the sharp end abuts against the abutted portion 73*a* of the second lever 73, thereby, even if dust or water adheres to the abutted portion 73*a*, the abutting portion 8*c* of the sharp end shape removes dust or water, and makes possible to surely transmit the releasing operation of the opening lever 8 to the first lever 71 through the second lever 73. In addition, on the opening lever 8, a shade portion 8*d* occluding the back face of the second lever 73 from the back side is provided. As a result, the adhesion of dust or water to the abutted portion 73*a* can be minimized.

In a state shown in FIG. 8, in the case that a door panel is deformed due to a crash or the like, a force for rotating the first outside lever 9 to the releasing direction acts directly or indirectly, so that when the ratchet 6 and the opening lever 8 rotate at an extremely high speed from the engagement position to the releasing direction (a rotation at extremely high speed which is much faster than a rotation at high speed which is far faster than speed of manually opening operation), the abutting portion 8*c* of the opening lever 8 abuts vigorously against the abutted portion 73*a* of the second lever 73. As a result, the first lever 71 is stopped at the initial position, only the second lever 73 rotates clockwise around the shaft 72 by a predetermined angle against the urging force of the second spring 75 and is displaced to the blocking position.

When the second lever 73 is displaced to the blocking position, the tip portion 73*b* of the second lever 73 is possible to abut against the stopper portion 2*q* of the engagement mechanism housing 2 from the counterclockwise direction, and the abutting portion 6*b* of the ratchet 6 abuts against the blocking portion 71*a* of the first lever 71 stopping at the initial position. As a result, it is prevented that the ratchet 6 rotates to the releasing direction.

Then, a constitution for preventing invasion of dust or water into the second region 22 and the third region 30 and a constitution related thereto will be described.

Figure 11:
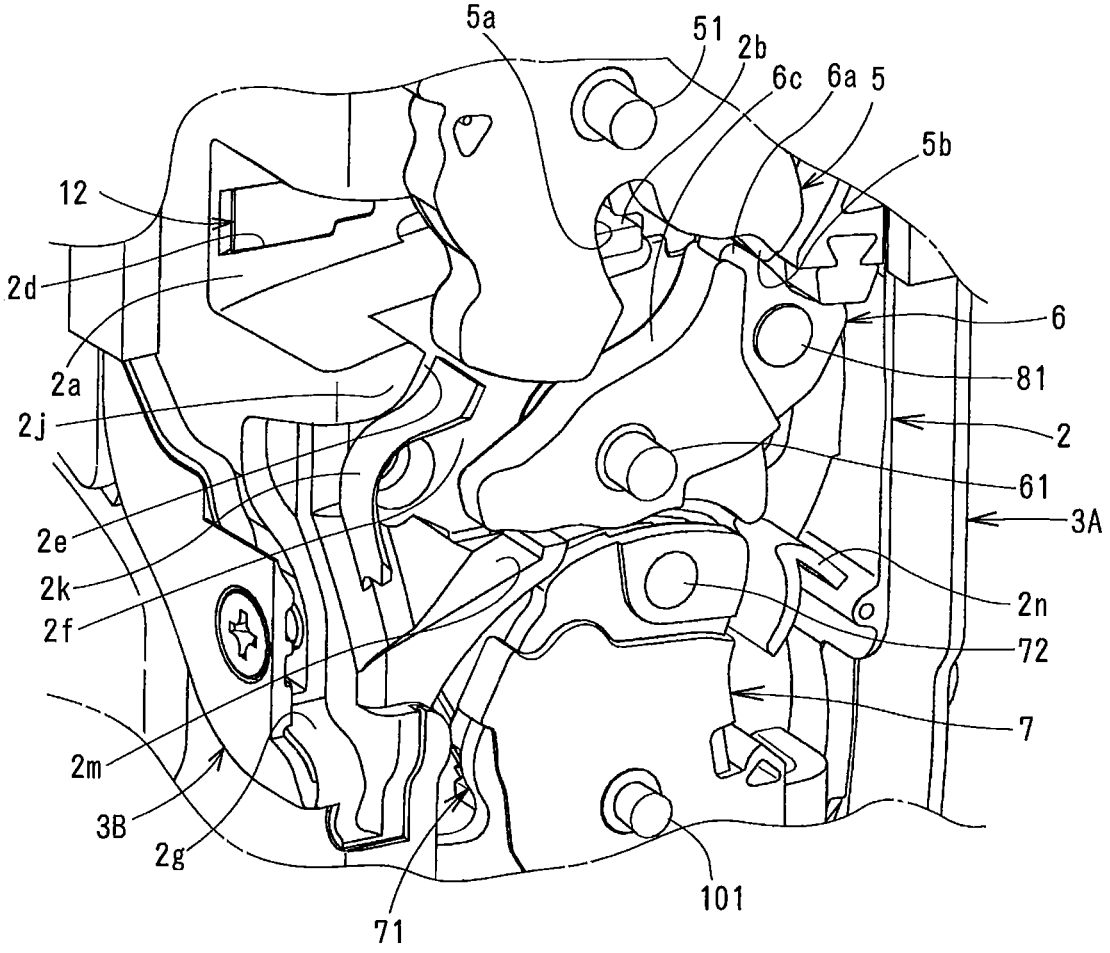
FIG. 11 is an enlarged perspective view of the main parts in an engagement mechanism housing.
Figure 12:
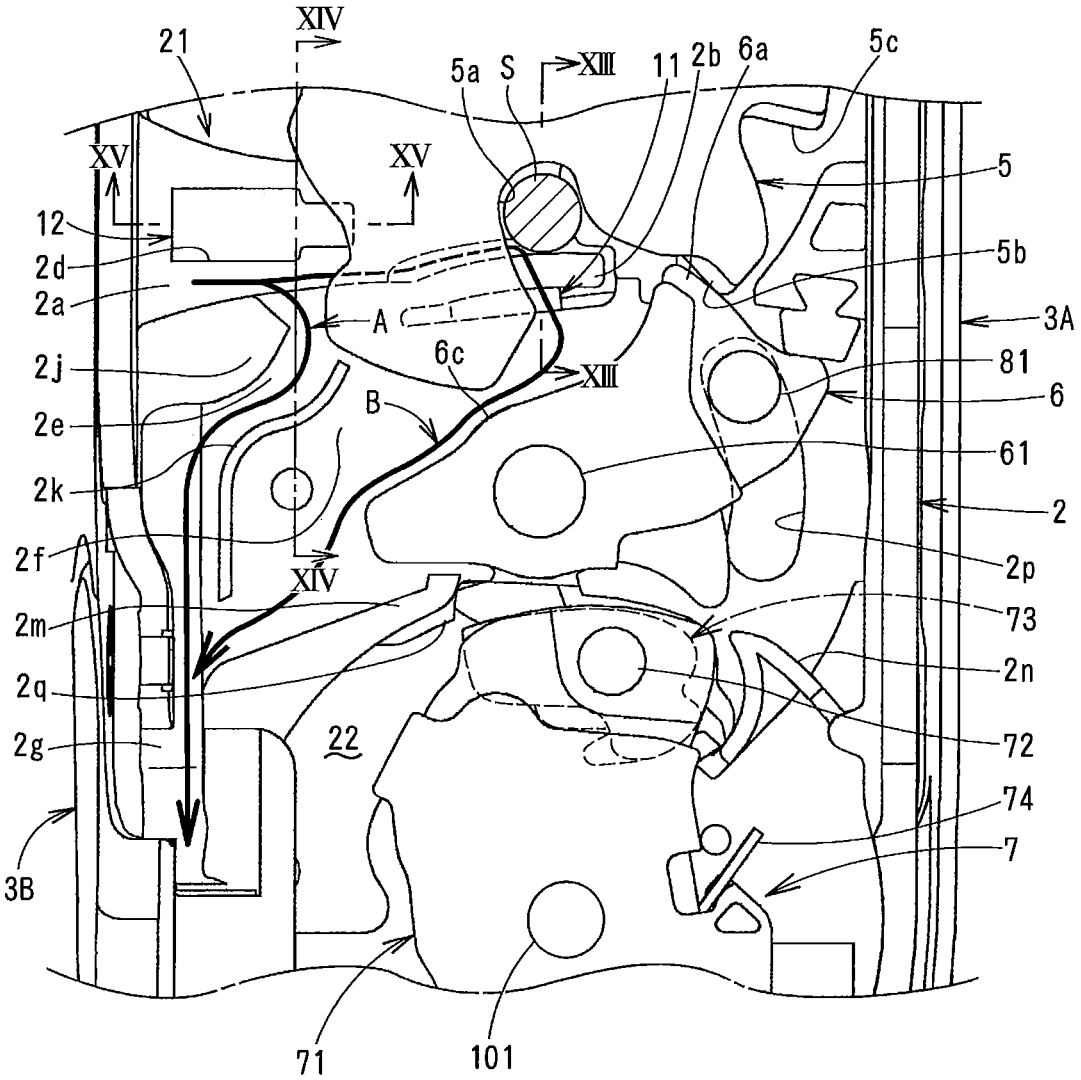
FIG. 12 is a front elevational view of the main parts in the engagement mechanism housing.
Figure 13:
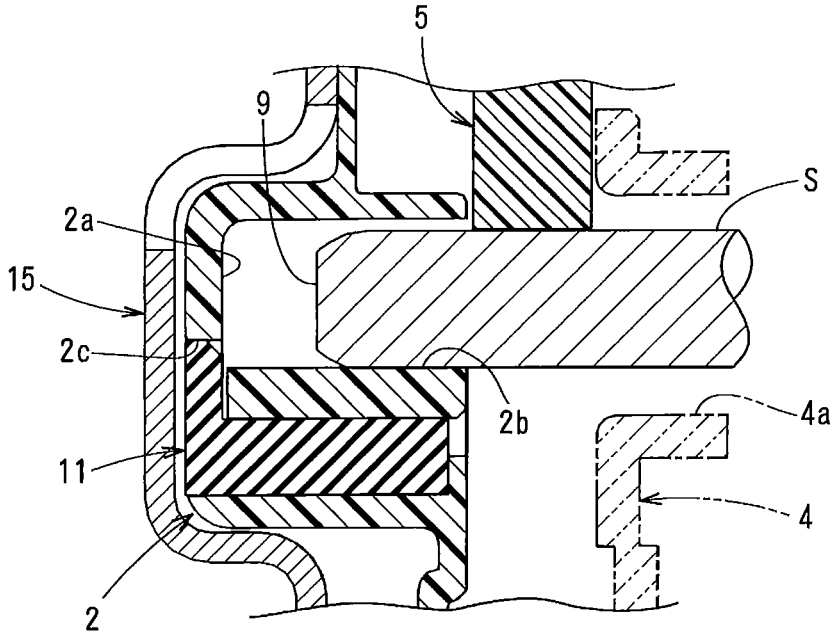
FIG. 13 is a cross-sectional view taken along the line XIII-XIII in FIG. 12.
Figure 14:
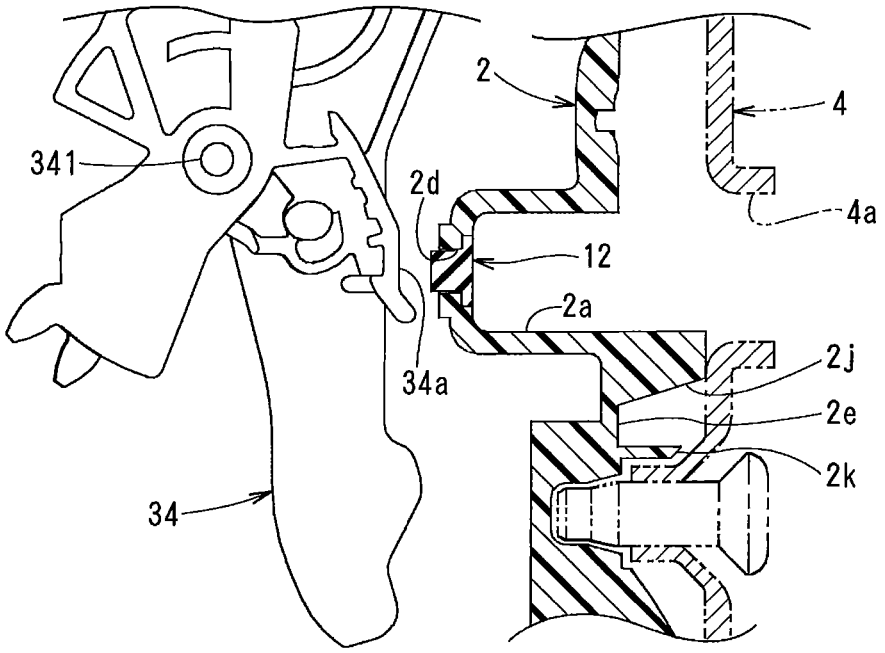
FIG. 14 is a cross-sectional view taken along the line XIV-XIV in FIG. 12.
Figure 15:
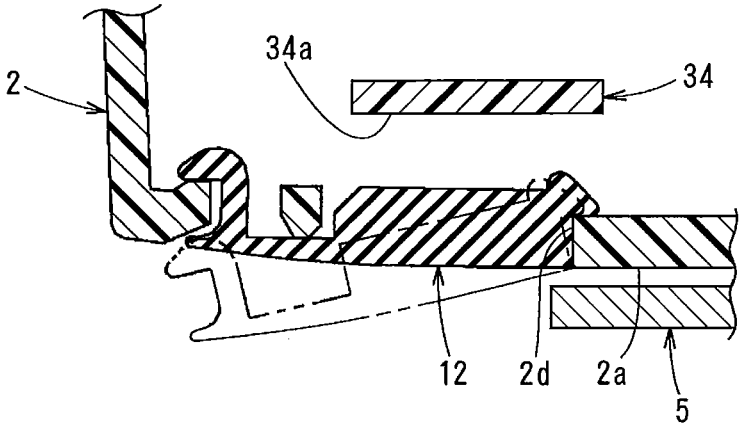
FIG. 15 is a cross-sectional view taken along the line XV-XV in FIG. 12.

FIG. 11 is an enlarged perspective view of the main parts in the engagement mechanism housing 2, FIG. 12 is an enlarged front elevational view of the main parts in the engagement mechanism housing 2, FIG. 13 is a cross-sectional view taken along the line XIII-XIII in FIG. 12, FIG. 14 is a cross-sectional view taken along the line XIV-XIV in FIG. 12, FIG. 15 is a cross-sectional view taken along the line XV-XV in FIG. 12 and FIG. 16 is a cross-sectional view taken along the line XVI-XVI in FIG. 8.

The entire region on the back side of the engagement mechanism housing 2 is covered with the operating mechanism housing 3. On the front face side of the engagement mechanism housing 2, when the door is closed, the striker entering groove 2*a* through which the striker S enters from the left side is provided. On the cover member 4, a striker entry cut-out portion 4*a* having a shape matching the striker entering groove 2*a* is provided. When the door is closed, the striker S enters the striker entry cut-out portion 4*a* of the cover member 4 and the striker entering groove 2*a* of the engagement mechanism housing 2 and is engaged with the engagement groove 5*a* of the latch 5.

As shown in FIGS. 11 and 12, in addition to the striker entering groove 2*a,* the engagement mechanism housing 2 comprises:

a tongue piece portion 2*b* positioned on a deep (right) lower surface of the striker entering groove 2*a,* first and second holes 2*c* and 2*d* (refer to FIG. 4) formed in the side surface of the striker entering groove 2*a* and penetrating in a front and back direction, first and second guide paths 2*e* and 2*f* inclining so as to flow dust or water (hereinafter referred to as "invasion fluid") to a left side, wherein the invasion fluid is dust or water that invades into the first region 21 of the engagement mechanism housing 2 from the striker entering groove 2*a,* and the left side is a relative direction (direction facing the inner panel side of the door) inclining to the direction that the striker S enters the striker entering groove 2*a,* a discharge path 2*g* flowing the invasion fluid toward a front side, that is, toward the cover member 4 side along the first and second guide paths 2*e* and 2*f,* and two discharge ports 2*h* and 2*i* (refer to FIG. 3) provided at a lowermost portion.

As can be understood from FIGS. 12 and 13, the tongue piece portion 2*b* of the engagement mechanism housing 2 abuts against the lower surface of the striker S entering the striker entering groove 2*a,* as a result, the vertical vibration of the striker S in the striker entering groove 2*a* is suppressed by an elastic force of an elastic body 11 provided on the lower side of the tongue piece portion 2*b*.

The elastic body 11 is formed of an elastic material such as rubber. As shown in FIG. 4, by being inserted into a first hole 2*c* from the back side of the engagement mechanism housing 2, as shown in FIG. 13, the elastic body 11 is fitted to the lower side of the tongue piece portion 2*b* and occludes the first hole 2*c*. As a result, it makes easy to assemble the elastic body 11 to the engagement mechanism housing 2, and it prevents that the invasion fluid invaded into the striker entering groove 2*a* invades from the first hole 2*c* into the back side of the engagement mechanism housing 2, that is, the third region 30.

A second hole 2*d* is on the side surface near the entrance of the striker entering groove 2*a*. As shown in FIGS. 14 and 15, the second hole 2*d* is formed at a position that an abutted portion 34*a* of the locking lever 34 faces the back side thereof, and is occluded by a lid body 12 formed of rubber or the like. As a result, it is prevented that the invasion fluid invaded into the striker entering groove 2*a* invades from the second hole 2*d* into the third region 30.

In addition, the second hole 2*d* is used when the vehicle door latch device 1 is applied to the door in which the key cylinder and the locking knob are abolished, and is otherwise occluded by the lid body 12. In the door that the key cylinder and the lock knob are abolished, switching of the unlocked/locked state of the locking/unlocking mechanism relies only on the power of the electric motor 32, so that when the operation of the electric motor 32 becomes impossible due to a failure of the electric system such as dead battery, there is a problem that the locking/unlocking mechanism cannot be switched to the locked state. In order to solve the problem, when the operation of the electric motor 32 becomes impossible, in the state that the door is opened, the lid body 12 is removed from the engagement mechanism housing 2 and the second hole 2*d* is opened. In this state, for example, a key is inserted into the second hole 2*d* and is abutted against the abutted portion 34*a* of the locking lever 34 positioned on the back side thereof. In this state, when the key is pushed to a deep side, the locking lever 34 rotates in the clockwise direction from the unlocking position shown in FIG. 14 and moves to the locking position, and the locking/unlocking mechanism is switched to the locked state. Then, in this state, the door can be the closed state by closing the door.

As shown in FIGS. 11 and 12, a first guide path 2*e* is formed in the lower portion near the entrance of the striker entering groove 2*a,* and is formed between a first eaves portion 2*j* projecting toward the front face side and a second eaves portion 2*k* located below the first eaves portion 2*j* and projecting toward the front face side in a shape inclined downward to the left side.

The second eaves portion 2*k* is located lower than the striker entering groove 2*a,* is on the left side of the arcuate hole 2*p,* is located higher than the second region 22 and is inclined so as to flow the invasion fluid to the left side. Although the arcuate hole 2*p* is occluded by the covering portion 8*a* of the opening lever 8, since it penetrates the engagement mechanism housing 2 in the front and back direction, it becomes a cause that the invasion fluid invades in the third region 30.

As shown in FIG. 12, among the invasion fluid that has invaded in the striker entering groove 2*a,* particularly the invasion fluid A that has invaded from the vicinity of the entrance of the striker entering groove 2*a* is received by the second eaves portion 2*k* located higher than the second region 22 and is guided to the left obliquely downward and in a opposite direction to the direction in which the arcuate hole 2*p* is provided. As a result, it is possible to guide the invasion fluid A to a direction not invading into the second region 22 and the third region 30, and to prevent that the invasion fluid A invades to the second region 22 and the third region 30.

A second guide path 2*f* is formed between the second eaves portion 2*k* and the third eaves portion 2*m* located below the second eaves portion 2*k*. The third eaves portion 2*m* is located below the second eaves portion 2*k* and above the second region 22, and projects toward the front face side in a shape that is inclined downward to the left side. In addition, the third eaves portion 2*m* is formed so that the portion leaving a right end portion thereof is located on the left side of a left end portion of the ratchet 6 and the right end portion is located on a lower right side of the left end portion of the ratchet 6. As a result, as shown in FIG. 12, among the invasion fluid, an invasion fluid B that has invaded from the deep side of the striker entering groove 2*a* flows to the left obliquely downward along an upper edge 6*c* that is inclined downward to the left side of the ratchet 6 and is received by the third eaves portion 2*m*, thus, the invasion fluid B flows toward a lower left side along the second guide path 2*f*.

The invasion fluids A and B guided by the first guide path 2*e* and the second guide path 2*f* are joined in the discharge path 2*g* corresponding to an each downstream portion and are discharged to the outside. In addition, on the cover member 4 occluding the front face side of the engagement mechanism housing 2, that is, the front face side of the first guide path 2*e* and the second guide path 2*f*, as shown in FIGS. 1 and 2, a cut-out shaped drainage portion 4*b* for opening the discharge path 2*g* is formed.

The first region 21 in the engagement mechanism housing 2 and the second region 22 below the first region 21 are partitioned by the third eaves portion 2*m* and a fourth eaves portion 2*n* provided to the right side thereof. As a result, the invasion fluid B is received by the third eaves portion 2*m*. In addition, since the invasion fluid invaded from the deep side of the striker entering groove 2*a* is received by the fourth eaves portion 2*n*, the invasion of invasion fluid into the second region 22 is reduced. As a result, the malfunction of the first and second levers 71, 73 that are the movable elements of the crash releasing prevention mechanism 7 can be prevented, and the operation of the movable elements can be ensured.

Even if the invasion fluid invades into the second region 22, the rainwater is discharged to the outside of the engagement mechanism housing 2 by the discharge ports 2*h* and 2*i* provided at the lowermost portion of the second region 22.

As described above, in the present embodiment, the invasion fluid that has invaded into the engagement mechanism housing 2 is guided in the outside direction that does not invade to the second and third regions 22 and 30, and the invasion into the second and third regions 22 and 30 is prevented. As a result, in the crash releasing prevention mechanism 7 disposed in the second region 22 and the locking/unlocking mechanism disposed in the third region 30, the adhesion of the invasion fluid to each movable element is reduced, the movement of each movable element of the crash releasing prevention mechanism 7 and the locking/unlocking mechanism is ensured.

Although one embodiment of the present invention has been described above, the following various variations and modifications can be made to the present embodiment within the scope not deviating from the gist of the present invention.

(a) Modifying the position, number and shape of the eaves portions 2*j*, 2*k*, 2*m*, 2*n* as appropriate.

(b) The ratchet 6 and the opening lever 8 are formed as an integral structure.

REFERENCE SIGNS LIST

1 vehicle door latch device
2 engagement mechanism housing
2*a* striker entering groove
2*b* tongue piece portion
2*c* first hole
2*d* second hole
2*e* first guide path
2*f* second guide path
2*g* discharge path
2*h*, 2*i* discharge port
2*j* first eaves portion
2*k* second eaves portion
2*m* third eaves portion
2*n* fourth eaves portion
2*p* arcuate hole
2*q* stopper portion
21 first region
22 second region
3 operating mechanism housing
3A first housing
3B second housing
30 third region
31 key lever
32 electric motor
33 inside lever
34 locking lever
34*a* abutted portion
341 shaft
35 lifting lever
35*a* releasing portion
36 reduction gear
4 cover member
4*a* striker entry cut-out portion
4*b* drainage portion
4*c* stopper portion
5 latch
5*a* engagement groove
5*b* full latch engaging portion
5*c* half latch engaging portion
51 latch shaft
6 ratchet
6*a* claw portion
6*b* abutting portion
6*c* upper edge
61 ratchet shaft
7 crash releasing prevention mechanism
71 first lever
71*a* blocking portion
71*b* stopper portion
72 shaft
73 second lever
73*a* abutted portion
73*b* tip portion
74 first spring
75 second spring
8 opening lever
8*a* covering portion
8*b* end portion
8*c* abutting portion
8*d* shade portion
81 connecting pin
9 first outside lever
9*a* one end portion
9*b* bent portion
91 shaft
10 second outside lever
10*a* one end portion
10*b* other end portion
101 shaft
11 elastic body
12 lid body
13 spring
14 Bowden cable
15 back member

What is claimed is:

1. A vehicle door latch device comprising:

a housing having a striker entering groove into which a striker enters;

a cover member occluding an opening of the housing;

a latch pivotally mounted in the housing so as to engage with the striker which has entered the striker entering groove;

a ratchet pivotally mounted in the housing so as to engage with the latch, and movable elements relating to operation of the ratchet, wherein the housing has a first guide path for guiding an invasion fluid to an outside direction of a region that the movable elements are disposed, and another guide path on a lower side of the first guide path, and at least one eaves portion is provided between the first guide path and the another guide path, wherein at an intermediate position in a longitudinal direction of the cover member, the first guide path and the another guide path are joined in a discharge path corresponding to each downstream portion, and a cut-out shaped drainage portion is formed for opening the discharge path and discharging the invasion fluids in the outside direction, wherein the first guide path and the another guide path are located lower than the striker entering the groove and higher than the region, wherein the outside direction is a relative direction that is inclined to an entering direction of the striker.

2. The vehicle door latch device according to claim 1, wherein the movable elements are a crash releasing prevention mechanism and are disposed lower than the ratchet in the housing, and the other guide path is constituted by another eaves portion that covers an upper side of the crash releasing prevention mechanism.

3. The vehicle door latch device according to claim 1, wherein the movable elements are a locking/unlocking mechanism disposed on a back side of the housing, and the locking/unlocking mechanism occludes a hole provided in the housing.

* * * * *